US011134332B2

(12) United States Patent
Manley

(10) Patent No.: US 11,134,332 B2
(45) Date of Patent: Sep. 28, 2021

(54) ACOUSTIC RECEIVER-IN-CANAL EAR TIP

(71) Applicant: Knowles Electronics, LLC, Itasca, IL (US)

(72) Inventor: Matthew Manley, Crystal Lake, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/710,263

(22) Filed: Dec. 11, 2019

(65) Prior Publication Data

US 2020/0213707 A1 Jul. 2, 2020

Related U.S. Application Data

(60) Provisional application No. 62/786,922, filed on Dec. 31, 2018.

(51) Int. Cl.
*H04R 1/10* (2006.01)

(52) U.S. Cl.
CPC ..... *H04R 1/1058* (2013.01); *H04R 1/1016* (2013.01)

(58) Field of Classification Search
CPC ..... H04R 1/1058; H04R 1/1016
See application file for complete search history.

(56) References Cited

U.S. PATENT DOCUMENTS 9,408,004 B2 * 8/2016 Higgins ..... H04R 25/60
2008/0285783 A1 11/2008 Gebert
2009/0134306 A1 * 5/2009 Koo ..... H04R 25/607 248/692
2010/0254556 A1 10/2010 Warren et al.

FOREIGN PATENT DOCUMENTS

EP 2819435 A1 12/2014

OTHER PUBLICATIONS

European Patent Office; International Search Report and Written Opinion; International Appl. No. PCT/US2019/065880; dated Apr. 7, 2020.
WIDEX; Audiological bulletin No. 50; Customising receiver ear-sets for Passion hearing aids and removing the battery drawer to connect programming cables; dated Mar. 29, 2010.

* cited by examiner

*Primary Examiner* — Regina N Holder
(74) *Attorney, Agent, or Firm* — Faegre Drinker Biddle & Reath LLP

(57) ABSTRACT

An ear tip for a hearing device includes a body member having a receiver retention portion that is communicably coupled to a sound port. The receiver retention portion is configured to receive and capture a receiver such as a balanced armature receiver. An electrical interface of the receiver is accessible via an opening in the receiver retention portion. The ear tip also includes an ear interface portion that is disposed at least partially about the body member. The ear interface portion is configured to be disposed in a user's ear canal. The ear interface portion and the body member are integrally formed as a unitary member.

19 Claims, 4 Drawing Sheets

ACOUSTIC RECEIVER-IN-CANAL EAR TIP

RELATED APPLICATIONS

This application claims priority to U.S. Provisional Patent Application Ser. No. 62/786,922 filed on Dec. 31, 2018, entitled "Acoustic Receiver-In-Canal Ear Tip," the entire contents of which is hereby incorporated by reference.

TECHNICAL FIELD

This application relates to ear tips for hearing devices and more specifically to ear tips with encapsulated receivers.

BACKGROUND

Hearing devices such as headphones, hearing aids and other sound emitting devices including a sound-producing electroacoustic device, such as a balanced armature receiver (also referred to herein as a receiver or speaker), and an ear tip for insertion into a user's ear canal are known generally. One such hearing device is a receiver-in-canal (RIC) device. In some RIC devices, the receiver is completely disposed in a RIC housing that includes an electrical cable connector or interface at one end and a nozzle for coupling to the ear tip at another end. In other RIC devices, the receiver is only partially disposed in a housing portion including the electrical cable connector and the nozzle is an integral part of the receiver rather than the RIC housing. An electrical cable connecting the RIC device to a behind-the-ear (BTE) processing module is usually permanently attached to the RIC device. The ear tip typically includes a body member having an ear interface portion and a sound passage with an inlet connectable to the nozzle and a sound outlet directed toward the user's ear canal in situ. A wax guard is often coupled to the nozzle.

RIC devices may perform poorly or become inoperable when infiltrated by excessive wax or debris. In such situations, components of the hearing device must be cleaned or replaced. For example, if wax infiltrates the receiver, the receiver must be cleaned or replaced by a technician. Also, the wax guard must be cleaned or replaced periodically. But many users find this latter task difficult due to the small size of the parts and the tedious nature of the replacement procedure. Other hearing devices having an ear tip such as some earphones may also be susceptible to wax and debris infiltration.

BRIEF DESCRIPTION OF THE DRAWINGS

For a more complete understanding of the disclosure, reference should be made to the following detailed description and accompanying drawings wherein.

Figure 1:
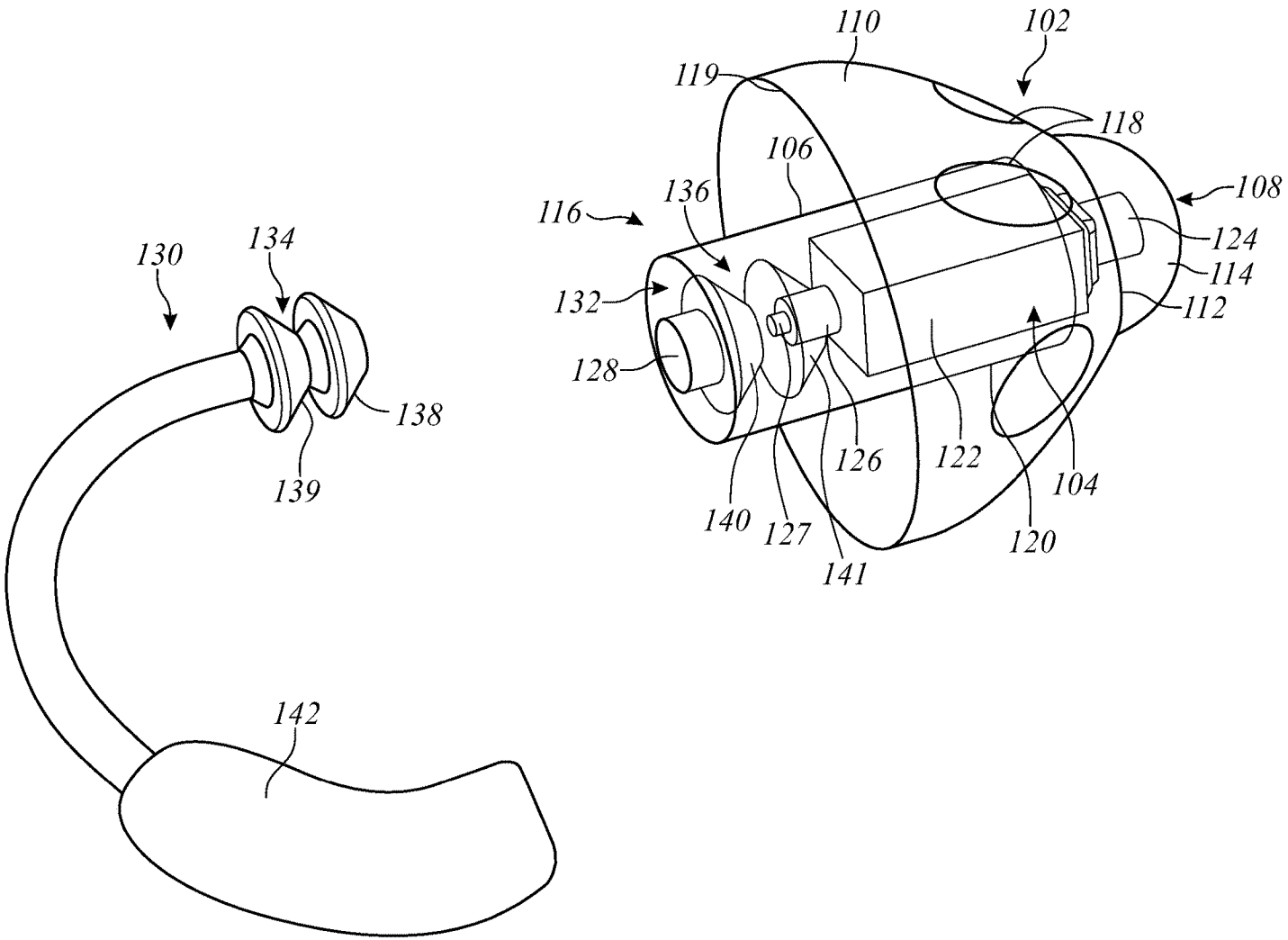
FIG. 1 is a side perspective view of a RIC device including an ear tip with an encapsulated receiver.

Skilled artisans will appreciate that elements in the figures are illustrated for simplicity and clarity. It will be appreciated further that certain actions and/or steps may be described or depicted in a particular order of occurrence while those skilled in the art will understand that such order or sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present disclosure relates generally to ear tips with one or more encapsulated receivers for hearing devices. The hearing device may be embodied as a receiver-in-canal (RIC) device electrically coupled to a behind-the-ear (BTE) unit. In other embodiments the hearing device is an in-the-ear (ITE) device or a completely-in-canal (CIC) device. The teachings of the present disclosure are also applicable to earphones, ear buds, wireless (e.g., Bluetooth) headsets and in-ear devices among other wearable devices that include an ear tip that contacts the user's ear canal.

In one embodiment, an ear tip subassembly for a hearing device comprises an ear interface portion disposed at least partially about a body member having a receiver retention portion. The ear interface portion is configured to be disposed at least partially in the user's ear canal. The receiver retention portion is configured to receive and retain a sound-producing acoustic device or receiver such that an acoustic output port of the receiver communicates with a sound port of the body member. The body member includes a connector interface through which an electrical interface of the receiver is connectable to an electrical connector. In one embodiment, the ear interface portion and the body member constitute an integrally formed member and in other embodiments the ear interface portion and the body member constitute an assembly of components, wherein the ear tip can be assembled with an acoustic receiver.

The sound-producing acoustic device or receiver may be embodied as a balanced armature receiver comprising a housing separated into a back volume and a front volume, having an acoustic output aperture, by a diaphragm mechanically linked to a motor disposed in the back volume. The motor includes a coil magnetically coupled to an armature movably balanced between two magnets, wherein the armature and diaphragm vacillate in tandem in response to application of an excitation signal to the coil via an electrical interface of the receiver. Alternatively, the receiver is a dynamic speaker or some other known or future sound-producing electroacoustic transduction device. These and other existing electroacoustic transducers are well known generally to those of ordinary skill in the art and not described further herein.

In another embodiment, an ear tip subassembly for a hearing device comprises a balanced armature receiver disposed in a receiver retention portion of a body member having an ear interface portion disposed at least partially about the body member, the ear interface portion formed of a resilient material and configured to be disposed at least partially in a user's ear canal, an acoustic output of the receiver communicably coupled to a sound port of the body member, and an electrical interface of the receiver electrically accessible via a connector interface of the body member, wherein the ear interface portion and the body member constitute an integral member.

In another embodiment, a receiver-in-canal (RIC) device comprises an ear tip having a dome portion integrally formed about a body member, a balanced armature receiver partially encapsulated by the body member, an acoustic output port of the balanced armature receiver acoustically coupled to a sound port of the ear tip, and an electrical interface of the balanced armature receiver electrically accessible via a connector interface of the ear tip, an electrical connector having an interface connector portion and contacts, the interface connector portion of the electrical connector removably connectable to the connector interface of the ear tip, wherein contacts of the electrical connector are electrically connected to contacts of the electrical interface of the balanced armature receiver when the interface connector portion of the electrical connector is coupled to the connector interface of the ear tip.

The ear tip generally comprises dome and receiver retention portions formed integrally or as an assembly. FIGS. 1-4 show an ear tip 102 with an encapsulated receiver 104. However, the receiver can be partially protruding from the receiver retention portion. The combined ear tip 102 and receiver 104 are removably connectable to an external device, examples of which are described further below, for ready servicing or replacement. Removal of the ear tip from the external device may facilitate servicing by a technician. In another use case an end user may remove and replace the ear tip from an electrical cable connected to the external device if the receiver or wax guard becomes excessively infiltrated with wax or debris, without servicing by a technician.

The ear tip 102 includes a body member 106 with a sound port 108 through which sound passes. The ear tip also includes an ear interface portion 110 disposed at least partially about the body member 106. The ear interface portion is formed of a resilient material (e.g., silicone) and is configured to be disposed at least partially in the user's ear canal. The body member and the ear interface portion can be integrally formed as a unitary member or as an assembly of parts. In FIGS. 1-4, the ear interface portion 110 has a dome shape or a quasi-dome shape having a base portion 119 that interfaces with the body member. FIGS. 1-4 also show the ear interface portion 110 coupled to the body member 106 at a transition radius 112, wherein a portion 114 of the body member protrudes beyond the radius. In other embodiments, the ear interface portion 110 may be devoid of the transition radius 112 and the protruding portion 114.

In some embodiments, the ear interface portion of the ear tip comprises one or more apertures through which ambient sound may pass. Such apertures may be used in RIC devices that complement ambient sounds with amplified sounds in a specified frequency range, e.g., higher frequencies. In FIGS. 1-4, a number of air holes 118 are disposed through the ear interface portion 110. While FIGS. 1-4 show three to four air holes, any suitable number of air holes may be included in other embodiments. Other embodiments do not include any air holes through the ear interface portion of the ear tip, wherein the ear tip forms a substantial seal with the user's ear canal. A substantial seal is not a perfect seal, but rather a seal that blocks a significant portion of the acoustic spectrum.

The body member 106 generally comprises an axial portion or dimension 116 along which the sound portion 108, a receiver retention portion 120, and a connector interface of the ear tip are arranged. The receiver retention portion is configured to receive and capture the receiver 104. The receiver retention portion is also communicatively coupled to the sound port 108. The receiver 104 generally comprises a housing 122 that includes an acoustic output port 124, and the receiver is oriented in the receiver retention portion so that the acoustic output port 124 is communicably coupled with the sound port 108 of the ear tip. Thus the receiver is partially encapsulated within the ear tip.

Figure 2:
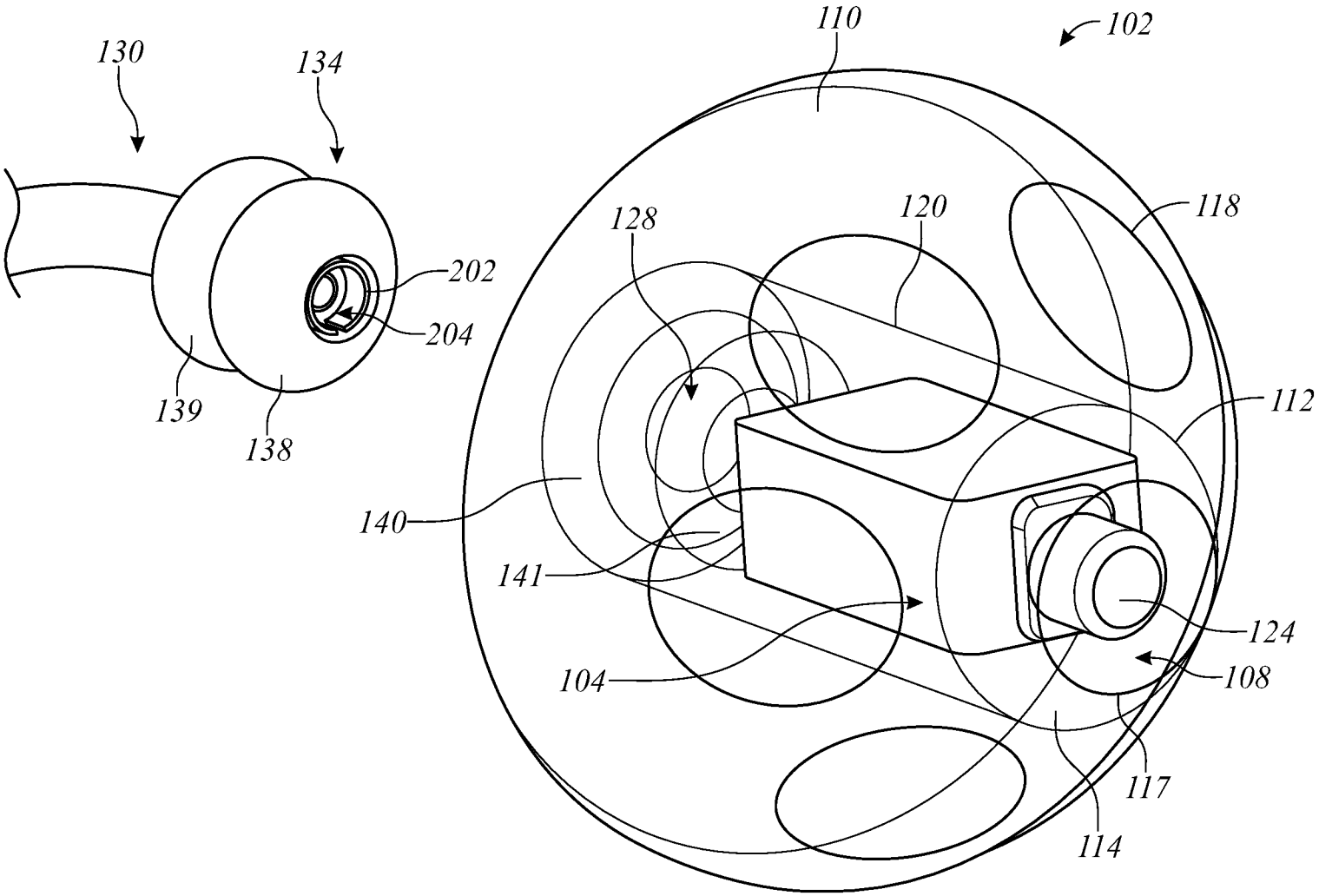
FIG. 2 is a front perspective view of a portion of the RIC device of FIG. 1.
Figure 3:
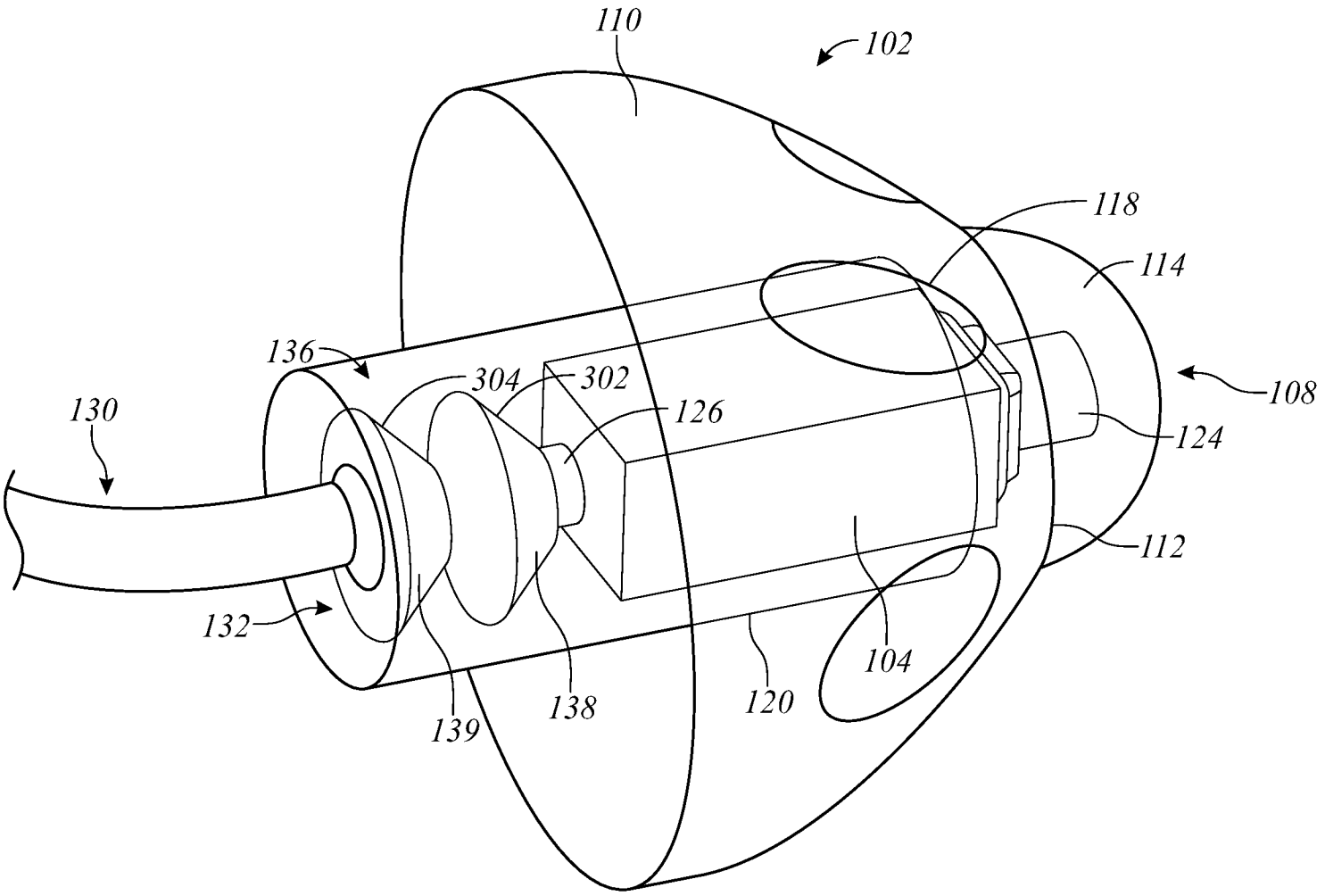
FIG. 3 is a side perspective view of an ear tip including an ear tip with an encapsulated receiver connected to an electrical cable.
Figure 4:
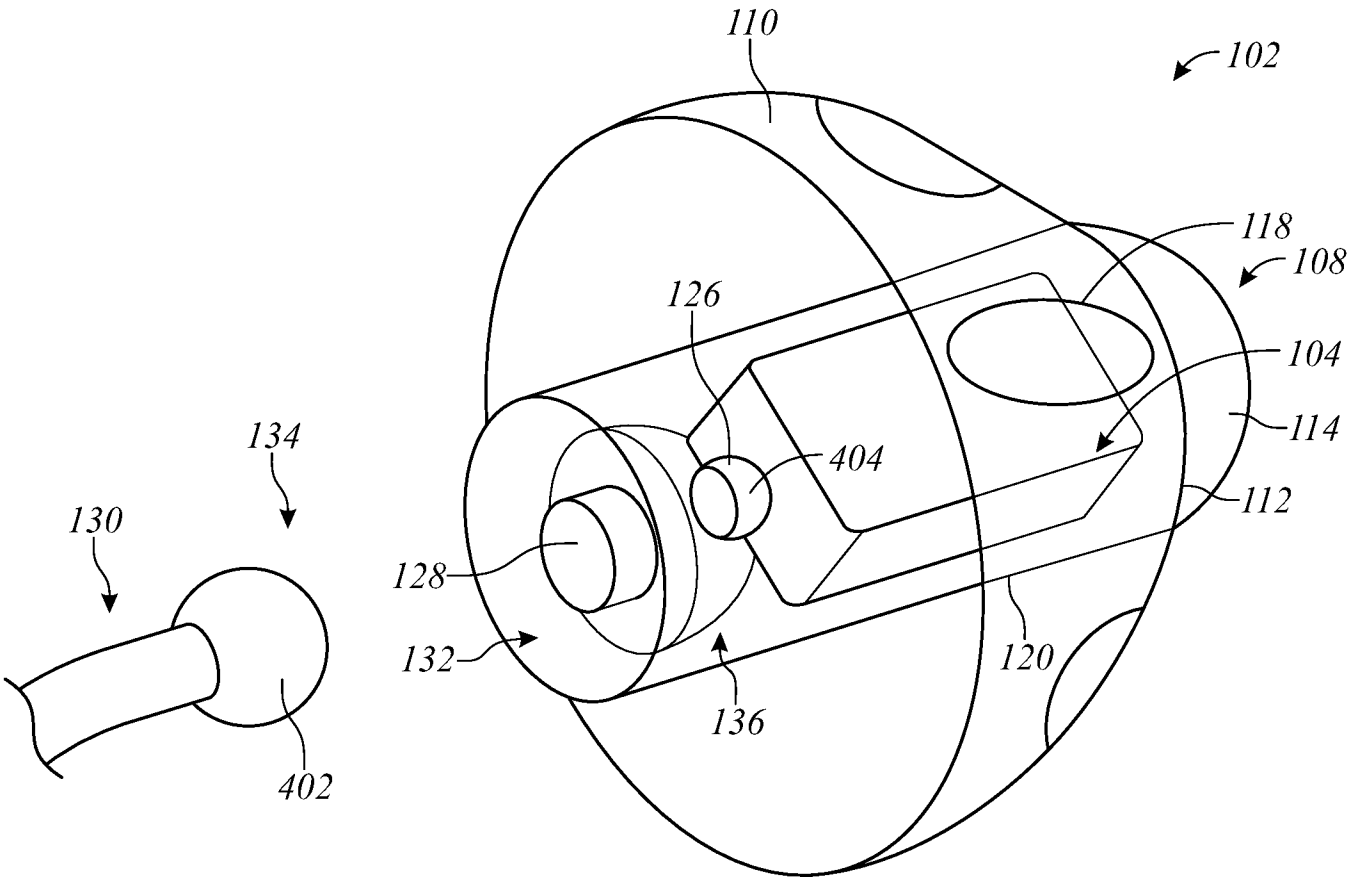
FIG. 4 is a side perspective view of another embodiment of an ear tip with an encapsulated receiver.

The body member generally comprises a connector interface that mates with an electrical connector electrically connectable to the receiver encapsulated by the body member. The connector interface is for electrically connecting the receiver to other electronic parts of the hearing device. In one implementation, an electrical cable is connected to the connector interface for this purpose, wherein the connector interface includes at least a mechanical interface portion configured to removably retain an interface connector portion of the electrical connector. In FIGS. 1-4, the connector interface includes an opening 128 forming a socket 132 with barb-shaped recesses 141, 141 that removably retain corresponding barbs 138, 139 of a connector portion 134 of an electrical connector 130. In other embodiments, the connector portion 134 and the socket portion 132 may have complementary shapes other than the barbs shown. FIG. 3 shows the connector portion 134 disposed in and retained by the electrical connector socket 132. In other embodiments, other configurations may be employed for mechanically coupling the electrical connector to the connector interface of the ear tip. For example, FIG. 4 shows the connector portion 134 configured as a ball joint connection having an outer ball 402 and an inner ball connection 404. In this embodiment, the outer ball is disposed over the inner ball and rotated to perfect the connection. The outer ball 402 is retained within a recess of the socket 132. In both embodiments, the location of the complementary recess and protrusion may be reversed.

Whatever the configuration of the mechanical coupling, in some embodiments, either the connector portion 134 or the socket portion 132 of the body member, or both, are sufficiently pliable to permit coupling and decoupling of the parts while maintaining a sufficiently reliable electrical connection between the electrical connector and the receiver. For example, the connector portion may be a relatively hard plastic material and the socket may be a relatively pliable silicone or other material, or vice-versa. Alternatively, both parts may somewhat pliable to permit coupling a decoupling.

The receiver generally comprises an electrical interface having contacts electrically connectable to an electrical signal source. In one embodiment, conductors of the electrical connector connect directly to an electrical interface of the receiver. In another embodiment, the conductors of the electrical connector and the contacts of the receiver are electrically connected by an intermediate electrical interface portion of the connector interface. FIG. 1 shows the receiver having a coaxial electrical interface with a male pin 127 electrically connectable to corresponding female receptacle of the electrical connector or cable 130 when the connector portion 134 is retained by the socket portion 132 of the body member. FIG. 2 shows the connector portion 134 including co-axial electrical contacts 202 a female receptacle 204. When the electrical connector 130 is mechanically coupled to the ear tip, the female receptacle 204 is mated with the male pin 127. In other embodiments, the locations of the male and female electrical connectors are reversed. In other embodiments, other electrical connection configurations may be employed for electrical coupling the signal source to the electrical interface of the receiver.

The ear tip 102 may be manufactured from any suitable elastomeric material such as polymer-based compounds like silicone, natural rubber, butyl rubber or soft neoprene, latex-based compounds and other natural or synthetic materials or combinations thereof. In the embodiments shown, the body member 106 and the ear interface portion 110 constitute an unassembled unitary member formed in a molding or other operation. In other embodiments, the body member and the ear interface portions are separate components that form an assembly. In some embodiments, the body member 106 has a hardness greater than a hardness of the ear interface portion 110. The harder body member or portion thereof may facilitate secure retention of the connector portion of the electrical cable and the softer ear interface portion will provide a more comfortable fit for the user. Such an ear tip may be formed in a multi-shot molding operation using different materials. Alternatively an inner body member or a connector interface portion thereof, formed from the harder material, is insert-molded within an outer body portion formed integrally with the ear interface portion.

The receiver 104 may be encapsulated in the receiver retention portion 120 during formation of the ear tip or the receiver may be inserted in receiver retention portion after formation of the ear tip. In one implementation, the receiver is insert-molded within the ear tip in an injection or other molding operation, wherein the volume in which the receiver is disposed corresponds to the receiver retention portion, resulting in an integrated subassembly to which an electrical cable is connectable. Alternatively, the receiver may be manually inserted into the receiver retention portion formed in a pliable portion of the body member via opening 128 after formation of the ear tip. In this case, the receiver retention portion is configured to provide a tight friction-fit with the inserted receiver wherein the acoustic output port 124 of the receiver is aligned with the sound port 108.

As described herein, a user can readily remove and replace the ear tip if the receiver malfunctions, has excessive wax infiltration, or otherwise. The encapsulation of the receiver also provides shock protection and vibration isolation to enable more usable amplifier gain. Moreover, the disclosed assembly represents a less costly design in which the receiver housing does not require an ear tip nozzle or other components used in prior art hearing devices.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. An ear tip for a hearing device, the ear tip comprising:

a body member having a receiver retention portion and a connector interface portion, the receiver retention portion being communicably coupled to a sound port of the body member;

the receiver retention portion configured to receive and capture a sound-producing electroacoustic device oriented so that an acoustic output of the sound-producing electroacoustic device communicates with the sound port of the body member;

the connector interface portion configured to receive and capture an electrical connector so that an electrical interface of the sound-producing electroacoustic device is coupled to the electrical connector in the connector interface portion; and an ear interface portion disposed at least partially about the body member, the ear interface portion formed of a resilient material and configured to be disposed at least partially in a user's ear canal, wherein the ear tip can be assembled with the sound-producing electroacoustic device.

2. The ear tip of claim 1, wherein the connector interface portion includes a structure configured to removably retain the electrical connector having conductors connectable to the electrical interface of the sound-producing electroacoustic device.

3. The ear tip of claim 1, wherein the connector interface portion includes a socket that mates with and removably retains a portion of the electrical connector when conductors of the electrical connector are electrically coupled to contacts of the sound-producing electroacoustic device received in the receiver retention portion of the body member.

4. The ear tip of claim 3, wherein the socket includes a ribbed structure configured to accommodate the portion of the electrical connector.

5. The ear tip of claim 1, wherein the ear interface portion has an aperture through a portion thereof.

6. The ear tip of claim 1 in combination with a sound-producing electroacoustic device disposed in and partially encapsulated by the receiver retention portion of the body member, the acoustic output of the sound-producing electroacoustic device communicably coupled with the sound port of the body member, and the electrical interface of the sound-producing electroacoustic device accessible via the connector interface portion.

7. The ear tip of claim 1, wherein the ear interface portion and the body member constitute an integral unit formed at least partially of a silicone material.

8. The ear tip of claim 1, wherein at least a portion of the body member has a hardness greater than a hardness of the ear interface portion.

9. An ear tip for a hearing device, the ear tip comprising:

a body member having a receiver retention portion and a connector interface portion, the receiver retention portion being coupled to a sound port of the body member;

a balanced armature receiver disposed in the receiver retention portion, the balanced armature receiver having an acoustic output communicably coupled to the sound port of the body member, the balanced armature receiver having an electrical interface electrically coupled to an electrical connector disposed in the connector interface portion; and an ear interface portion disposed at least partially about the body member, the ear interface portion formed of a resilient material and configured to be disposed at least partially in a user's ear canal, wherein the ear interface portion and the body member constitute a unitary member.

10. The ear tip of claim 9, wherein the connector interface portion includes a socket having a structure configured to removably retain a mating portion of the electrical connector.

11. The ear tip of claim 9, wherein the body member has an axial dimension along which the sound port, the receiver retention portion and the connector interface portion are arranged, the ear interface portion disposed about the axial portion of the body member and having a dome shape or a quasi-dome shape, and the ear interface portion having an aperture through a portion thereof.

12. The ear tip of claim 9 in combination with the electrical connector having a connector portion with electrical contacts, the connector portion disposed and removably retained by the connector interface portion of the body member, contacts of the electrical connector being electrically coupled to contacts of the electrical interface of the balanced armature receiver.

13. The ear tip of claim 12, wherein the connector interface portion includes a socket with a surface configured to removably retain the connector portion of the electrical connector.

14. The ear tip of claim 9 includes a silicone material.

15. The ear tip of claim 9, at least a portion of the body member has a hardness greater than a hardness of the ear interface portion.

16. The ear tip of claim 9, wherein the balanced armature receiver is insert molded within the receiver retention portion of the body member.

17. A receiver-in-canal (RIC) device comprising:

an ear tip having a dome portion and a body member, the ear tip having a sound port and a connector interface;

a balanced armature receiver encapsulated by the body member of the ear tip, an acoustic output port of the balanced armature receiver being acoustically coupled to the sound port of the ear tip;

an electrical connector encapsulated by the connector interface of the ear tip, an electrical interface of the balanced armature receiver being electrically coupled to the electrical connector in the connector interface of the ear tip; and the electrical connector having an interface connector portion and contacts, the interface connector portion of the electrical connector being removably connectable to the connector interface of the ear tip, wherein the contacts of the electrical connector are electrically connected to contacts of the electrical interface of the balanced armature receiver when the interface connector portion of the electrical connector is coupled to the connector interface of the ear tip.

18. The RIC device of claim 17, wherein the connector interface of the ear tip includes a barb and the interface connector portion of the electrical connector includes at least one recessed surface that engages the barb to removably retain the contacts of the electrical connector in electrical contact with contacts of the electrical interface of the balanced armature receiver.

19. The RIC device of claim 17, wherein the dome portion and the body member of the ear tip constitute a unitary member.

* * * * *